US008887544B2

(12) United States Patent
Ishiguro et al.

(10) Patent No.: US 8,887,544 B2
(45) Date of Patent: Nov. 18, 2014

(54) CONVEYOR APPARATUS AND HOT PRESS-FORMING APPARATUS COMPRISING THE SAME

(75) Inventors: Katsunori Ishiguro, Toyota (JP); Masaki Furuhashi, Toyota (JP)

(73) Assignee: Aisin Takaoka Co., Ltd., Toyota-Shi, Aichi (JP)

( * ) Notice: Subject to any disclaimer, the term of this patent is extended or adjusted under 35 U.S.C. 154(b) by 448 days.

(21) Appl. No.: 12/808,087

(22) PCT Filed: Sep. 26, 2008

(86) PCT No.: PCT/JP2008/067476
§ 371 (c)(1),
(2), (4) Date: Jun. 14, 2010

(87) PCT Pub. No.: WO2009/075135

PCT Pub. Date: Jun. 18, 2009

(65) Prior Publication Data

US 2010/0288008 A1 Nov. 18, 2010

(30) Foreign Application Priority Data

Dec. 13, 2007 (JP) ..... 2007-322508

(51) Int. Cl.
*B21D 43/10* (2006.01)

(Continued)

(52) U.S. Cl.
CPC ..... *B21D 43/055* (2013.01); *C21D 1/673* (2013.01); *B21D 43/11* (2013.01);

(Continued)

(58) Field of Classification Search
USPC ..... 72/342.1, 296, 305, 361, 72/405.11–405.13, 419–421, 426, 428, 72/409.01, 409.09, 422, 287; 269/43, 136, 269/137, 138; 219/775, 388, 700, 755, 653, 219/655, 658; 414/19; 198/345.1, 406, 407, 198/413, 346.1, 346.2, 346.3, 463.3, 198/736–749
See application file for complete search history.

(56) References Cited

U.S. PATENT DOCUMENTS 5,060,500 A * 10/1991 Ohneda et al. ..... 72/287
6,347,540 B1 * 2/2002 De Biasi ..... 72/405.16
7,285,761 B1 10/2007 Terziakin

FOREIGN PATENT DOCUMENTS

DE 19506071 A1 * 8/1996
JP 4-17400 2/1992

(Continued)

OTHER PUBLICATIONS

English translations of Japanese patent application JP 2007-136533, "Forming method using transfer press and transferpress device", by I. Yuichi and S. Tetsuo, Jun. 7, 2007.*
English translations of Japanese patent application JP 2002-248525, "Method for hot pressing metal plate and apparatus therefor", by H. Koichi, N. Masahito, K. Yoshiyuki, Sep. 3, 2002.*

(Continued)

*Primary Examiner* — Shelley Self
*Assistant Examiner* — Chwen-Wei Su
(74) *Attorney, Agent, or Firm* — Buchanan Ingersoll & Rooney PC

(57) ABSTRACT

A conveyor apparatus conveys work that was conduction heated at an energizing position to a processing position that is separated from the energizing position in the horizontal direction in order to perform hot press-forming, and comprises: a holding member that freely clamps both end sections in the lengthwise direction of the work that has been conduction heated; a drive mechanism that moves the holding member from at least the energizing position to the processing position; and a guide member that extends between the energizing position and the processing position and guides and supports the middle section in the lengthwise direction of the work that has been conduction heated and is being conveyed toward the processing position. A hot press-forming apparatus comprises the conveyor apparatus when conveying conduction heated work to a downstream process.

17 Claims, 8 Drawing Sheets

(51) Int. Cl.

| | |
|---|---|
| ***C21D 1/673*** | (2006.01) |
| ***B21D 43/05*** | (2006.01) |
| ***B21D 43/11*** | (2006.01) |
| ***B21D 22/02*** | (2006.01) |
| ***B21D 43/00*** | (2006.01) |
| ***C21D 1/34*** | (2006.01) |

(52) U.S. Cl.

CPC ..... *B21D 22/022* (2013.01); *B21D 43/003* (2013.01); *C21D 1/34* (2013.01)

USPC ..... 72/342.1; 72/296; 72/305; 72/361; 72/405.11; 72/405.12; 72/405.13; 72/421; 72/426; 72/428; 198/463.3; 198/747

(56) References Cited

FOREIGN PATENT DOCUMENTS

| | | | |
|---|---|---|---|
| JP | 2002-248525 | A | 9/2002 |
| JP | 2005-342742 | A | 12/2005 |
| JP | 2006-289425 | A | 10/2006 |
| JP | 2007-136533 | A | 6/2007 |
| JP | 2007-175722 | A | 7/2007 |
| JP | 2007175722 | A * | 7/2007 |

OTHER PUBLICATIONS

English translations of Japanese patent application JP H10-315000, "Press", by K. Kazunori and M. Saburou, Feb. 12, 1998.*

English translations of Japanese patent application JP 2005-342742, "Method and apparatus for pressing galvanized steel sheet and pressed goods made of galvanized steel sheet", by M. Yutaka, Dec. 15, 2005.*

International Search Report issued by the Japanese Patent Office as the International Searching Authority on Dec. 12, 2008 in International Application No. PCT/JP2008/067476.

English Translation of the International Preliminary Report on Patentability (IPRP) (Forms PCT/IB/338 and PCT/IB/373) and Written Opinion of the International Searching Authority and International Preliminary Report on Patentability (Form PCT/ISA/237) issued in corresponding International Application No. PCT/JP2008/070120 dated Aug. 10, 2010.

Official Action dated Jan. 5, 2011, issued by the Japanese Patent Office in corresponding Japanese Patent Application No. 2007-322508, and English translation of Official Action.

Extended European Search Report dated Jul. 24, 2013 issued in corresponding European Patent Application No. 08 859 427.0.

* cited by examiner

CONVEYOR APPARATUS AND HOT PRESS-FORMING APPARATUS COMPRISING THE SAME

CROSS-REFERENCE TO RELATED APPLICATION

This application is based upon and claims the benefit of the priority of Japanese patent application No. 2007-322508 filed on Dec. 13, 2007, the disclosure of which is incorporated herein in its entirety by reference thereto.

TECHNICAL FIELD

The present invention relates to a conveyor apparatus and hot press-forming apparatus comprising the same, and more particularly to a conveyor apparatus for die quenching and a hot press-forming apparatus comprising the same.

BACKGROUND

One method of mass producing automobile parts that require high strength employs a hot press-forming method or die quenching method. The die quenching method is a method in which a steel plate is heated to approximately 900° C., after which the steel plate is rapidly cooled at the same time that press-forming is performed and the formed product is quenched. Moreover, in order to heat the steel plate, conventionally a continuous heating furnace that is provided separately from the press-forming apparatus is typically used.

A hot press-forming system disclosed in Patent Document 1 employs a radiation heater that has this kind of heating furnace, where this radiation heater is provided separately from the hot press-forming apparatus in the stage before the hot press-forming apparatus. In addition, in patent document 1, a "walking beam, pusher and slider, belt conveyor, chain conveyor, and press transfer arm" are disclosed.

In Patent Document 2, a conveyor apparatus is disclosed that supports a metal material from the underneath side and conveys that material to the hot press mechanism by placing the middle section of the metal sheet that has been heated by the heating furnace on forks, and driving the forks along the conveyance direction.

[Patent Document 1] Japanese Patent Kokai Publication No. JP-P2006-289425A

[Patent Document 2] Japanese Patent Kokai Publication No. JP-P2007-175722A

SUMMARY

The entire disclosures of the above Patent Documents 1 and 2 are incorporated herein by reference thereto. The analysis set forth below is given by the present invention.

The heated work is soft, so while conveying the heated work, there is a possibility that warping or bending of the work may occur. When the work is conveyed to the hot press-forming process in a warped state, the warped section of the work may interfere with the jigs and dies. In patent document 1 nothing is disclosed related to this problem that occurs when conveying the heated work.

With the conveyor apparatus disclosed in patent document 2, when conveying the metal material, the material is only supported from the underneath side, so there is a problem in that it is easy for the position of the metal material to shift, so that positioning in the hot press mechanism takes time, as well as it is difficult to increase the conveying speed.

It is an object of the present invention to provide a conveyor apparatus and a hot press-forming apparatus comprising the same, that when conveying heated work through direct conduction of electric current (termed as "conduction heated" or "conduction heating" hereinafter) to a downstream process, is able to prevent or suppress thermal deformation of the work, and make it easy to perform positioning of the work in a downstream process. In further aspects, it is an object to provide a conveying method and a hot press-forming method.

According to a first aspect of the present invention, there is provided a conveyor apparatus that conveys a work that has been conduction heated at an energizing position (i.e., conduction-heating position) to a processing position that is separated in the horizontal direction from the energizing position in order to perform hot press-forming, and comprises: a holding member(s) that freely clamps both end sections in the lengthwise direction of the work that has been conduction heated; a drive mechanism that moves the holding member from at least the energizing position to the processing position; and a guide member that extends between the energizing position and processing position and is capable of guiding and supporting a middle section in a lengthwise direction of the work that has been conduction heated and is under conveyance toward the processing position. According to a second aspect of the present invention, there is provided a hot press-forming apparatus that comprises the conveyor apparatus. According to a third aspect of the present invention, there is provided a conveying method for conveying work that has been conduction heated at an energizing position to a processing position that is separated in a horizontal direction from the energizing position in order to perform hot press-forming; wherein the method comprises: freely clamping, by a holding member(s), both end sections in the lengthwise direction of the work that has been conduction heated; moving the holding member(s) from at least the energizing position to the processing position, using a drive mechanism; and guiding and supporting a middle section in a lengthwise direction of the work that has been conduction heated and is under conveyance toward the processing position, by using a guide member(s).

According to a fourth aspect of the present invention, there is provided a hot press-forming method that uses the conveying method of the third aspect.

According to a fifth aspect of the present invention, there is provided a method of producing a hot press-forming product using the hot press-forming method.

When performing hot press-forming, and particularly when holding both ends of heated work in order to perform die quenching, the middle section of the work droops, and when the holding force is very large, the work elongates in the lengthwise direction. With the present invention, by holding both ends of the work by a holding member when conveying conduction heated work, positioning the work at a downstream process, or in other words, positioning the work at the hot press-forming process is simplified, and by supporting and guiding the middle section of work by a guide member, it is possible to prevent or suppress thermal deformation of the work such as drooping of the middle section of the work or elongation of the work due to holding. As a result, when conveying conduction heated work from the energizing position to the processing position, interference between the work and the parts of the conveyor apparatus is prevented, and it is possible to convey the work to the processing position in a positioned state, and thus positioning at the processing position becomes easy, and hot press-forming can be executed quickly. Moreover, by conveying the work in a supported state, shifting of the position of the work is prevented, so it is also possible to increase the speed of conveying the work from the energizing position to the processing position.

BRIEF DESCRIPTION OF THE DRAWINGS

FIG. 3A is a top plan view, FIG. 3B is a front view and FIG. 3C is a side view.

PREFERRED MODES

Figure 1:
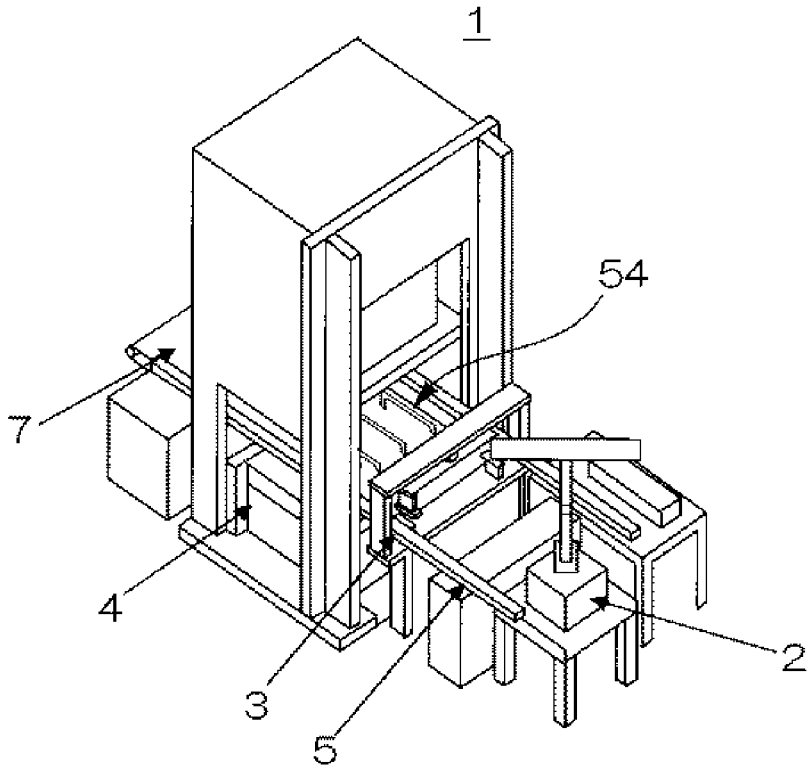
FIG. 1 is an external view of a hot press-forming apparatus having a conveyor apparatus of an example of the present invention.

In preferred modes of the present invention, at least the processing position is located at the same height as the energizing position, the guide member extends between the energizing position and the processing position and is inclined so that the processing position side thereof is higher than the energizing position side. Furthermore, it is preferred that the work or blank feeding position, the energizing position, the processing position and the work or formed product discharge position be at the same height. In these modes, conveying is made simple and efficient, and transfer type conveyance can be easily applied to the conveyor apparatus of the present invention.

In a preferred mode of the present invention, the guide member is a rail on which an undersurface of the work is slidable. It is further preferred that a plurality of guide members be arranged with respect to the lengthwise direction of the work. In this mode, warping or deflection of the work can be prevented or suppressed even when the work is an elongated sheet material and the spacing between the support positions is large.

In a preferred mode of the present invention, the holding members at least freely support the work at the energizing position and processing position, as well as freely move back-and-forth between both the positions. In this mode, by moving the holding members back-and-forth, the conveyor apparatus can be simply constructed.

In a preferred mode of the present invention, a plurality of holding members are provided, and together with freely holding the work at the work feeding position and at the discharge position where the hot press-formed work is discharged, freely move back-and-forth between the feeding position and energizing position, between the energizing position and the processing position, and between the processing position and the discharge position. In this mode, the whole conveyor apparatus can be simply constructed and work is conveyed efficiently. In addition, synchronizing the conveyance of a plurality of works, or in other words, blanks and formed products can be performed easily, and thus the time required to perform a series of cycles, which include feeding (setting) a blank, heating, hot pressing and discharging the formed product, can be reduced.

The conveyor apparatus of a preferred mode of the present invention is located along the conveyance direction of the blank and has a pair of parallel arms to which a pair of the holding members are mounted, and the drive mechanism comprises: a conveyance direction drive mechanism that drives the pair of parallel arms such that they freely move along the conveyance direction; a raising (lifting) and lowering mechanism that drives the pair of parallel arms such that they freely move back-and-forth along the up and down (vertical) direction; and a width direction drive mechanism that drives the pair of parallel arms such that they freely move back-and-forth in the width direction perpendicular to the conveyance direction and up and down direction so that the holding members can freely hold the work. In this mode, the conveyor apparatus is compact and work is conveyed efficiently.

Figure 3A:
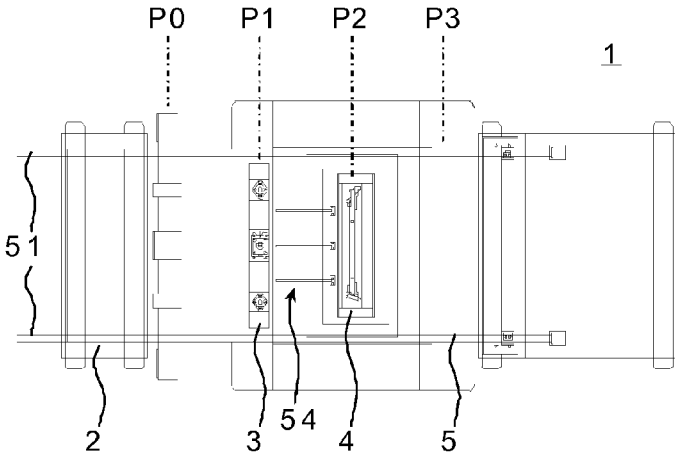
FIGS. 3A to 3C are three drawings for explaining the hot press-forming apparatus shown in FIG. 1, where
Figure 3B:
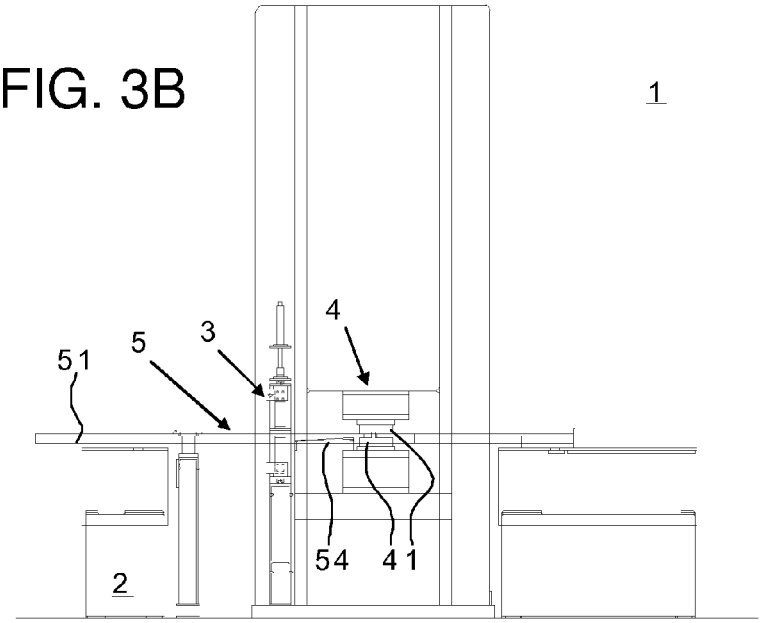
Figure 3C:
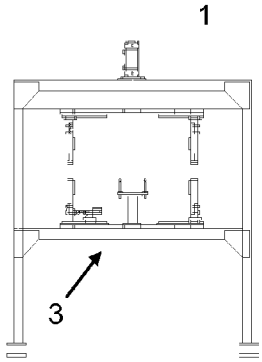
Figure 7:
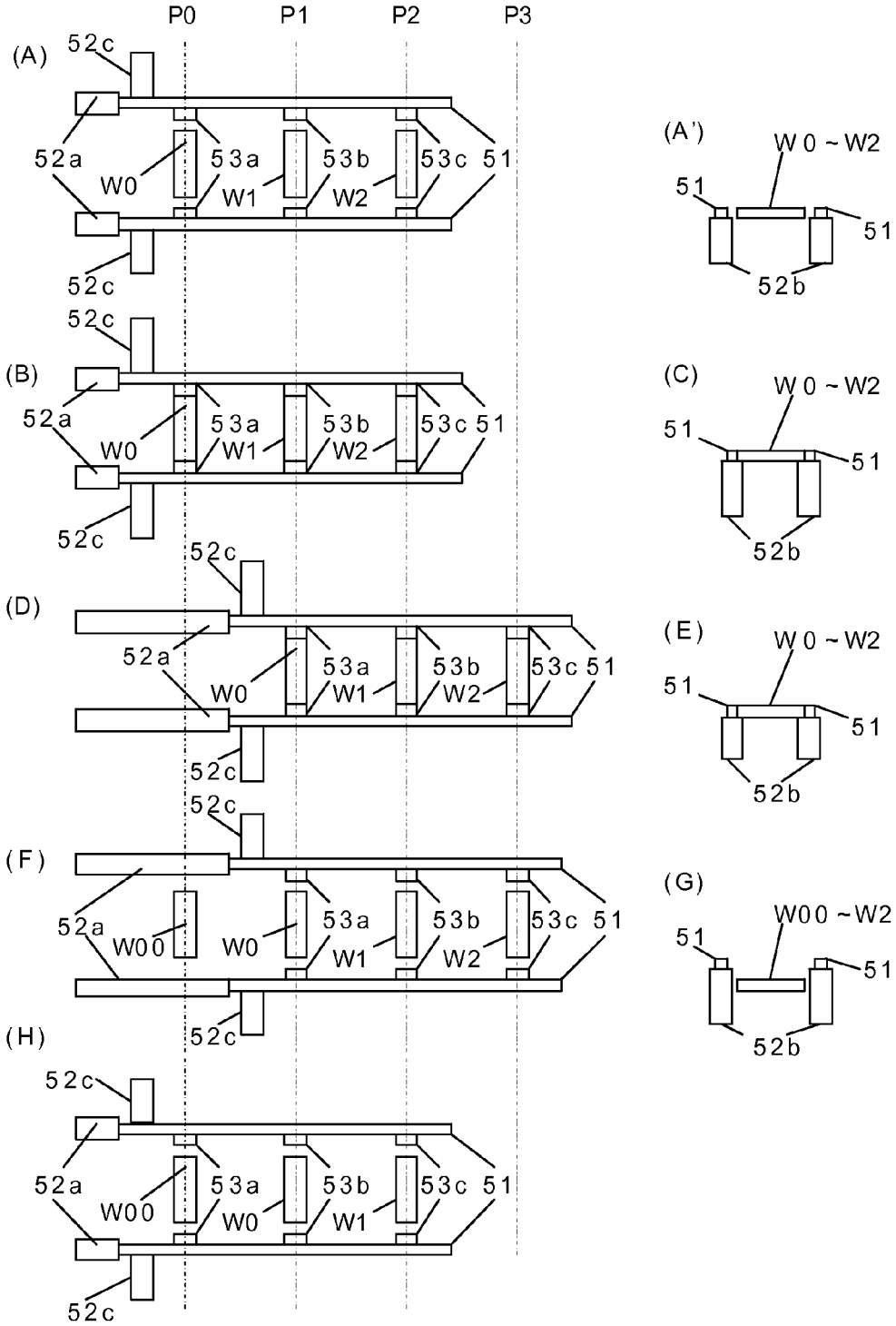
FIGS. 7A to 7H are process diagrams for explaining the basic conveying process of the conveyor apparatus of an example of the present invention.

In a preferred mode of the present invention, as illustrated in FIG. 3A to FIGS. 3C and (B) to (C) of FIG. 7, the conveyor apparatus comprises: a holding member(s) 53*b* that freely clamps both end sections in the lengthwise direction of the conduction heated work W1, a drive mechanism 52*a* that drives and moves the holding member(s) 53*b* in the traverse direction from at least the energizing position P1 to the processing position P2, and a guide member 54 that extends between the energizing position P1 and processing position P2, which are positioned at the same height, is inclined so that the processing position P2 side is higher than the energizing position P1 side, and freely supports and guides the middle section in the lengthwise direction of the conduction work W1 that is under conveyance toward the processing position P2; where the holding member 53*b* freely supports the work W1 at least at the energizing position P1 and processing position P2, as well as freely moves back-and-forth between both the positions P1 and P2. Furthermore, preferably a plurality of holding members 53*a* to 53*c* are provided that together with freely holding work WW0 to W2 at the feeding position P0 of work W0, and discharge position P3 where the hot press-formed work W2 or formed product is discharged, freely moves back-and-forth between the feeding position P0 and energizing position P1, between the energizing position P1 and processing position P2, and between the processing position P2 and discharge position P3.

In a preferred mode of the present invention, the hot press-forming apparatus comprises a cooling die that together with performing hot pressing of the work, also performs rapid cooling and quenching. In this mode, the energizing position and the processing position are arranged such that they are separated, so that with the die of the hot press mechanism or cooling die, sufficient rapid cooling is possible at the same time as hot pressing, and it is possible to adequately quench the formed product. Preferably the hot press-forming apparatus comprises a forced cooling die, or depending on the circumstances, a cooling die that maintains a temperature at which it is possible to execute die quenching by natural cooling. The hot press-forming apparatus may also comprise a path that is formed in the die and through which a fluid such as water, oil or air circulates, and a pump for circulating the fluid in the path.

The conveyor apparatus of a preferred mode of the present invention performs a process of conveying heated work from the energizing position to the processing position, while at the same time performs a process of conveying formed products from the processing position to the discharge position where work is discharged, and further performs a process of feeding new work to the energizing position. In this mode, it is possible to simultaneously execute a supply process of supplying work or blanks to the equipment, a conveyance process of conveying heated work inside the equipment and a discharge process of discharging work or formed products from the equipment, so the conveyor apparatus and conveyance process can be simplified.

In a preferred mode of the present invention, the hot pressing is die quenching that performs rapid cooling and quenching during hot pressing.

In a preferred mode of the present invention, a heated blank is quickly conveyed from the energizing position to the processing position within 10 seconds, and preferably within 5 seconds or less, in order to prevent or suppress the blank temperature from dropping or the blank from oxidizing.

In a preferred mode of the invention, conduction heating is sufficient as long the work can be heated to a temperature at which hot press-forming is possible. For example, when the work is steel, between the critical point A1 and the liquid-phase precipitation point, conduction heating should be between 850 and 1200° C. In addition, by setting the temperature of the die of the hot press mechanism to between room temperature and approximately 250° C., it is possible, for example, to cool a blank that has been heated to the A1 point or above at a rate of 20° C./s or more until the temperature reaches approximately 220° C. or less and sufficient quench hardening is obtained.

The present invention can be applied to conveying various kinds of materials and various metal work such as steel or aluminum that are capable of conduction heating, thermal processing and particularly die quenching.

EXAMPLES

Examples of the present invention will be explained below with reference to the accompanying drawings. FIG. 1 is an external view of a hot press-forming apparatus comprising the conveyor apparatus of an example of the present invention.

As illustrated in FIG. 1, the hot press-forming apparatus 1 comprising a conveyor apparatus 5 of an example of the present invention is assembled with: a conduction heating mechanism 3 that energizes and heats work or blanks, which have been supplied one at a time from an feeding mechanism 2, at an energizing position; a die-quenching type hot press mechanism 4 that performs hot press-forming at a processing position that is thermally separated from and at downstream of the conduction heating mechanism 3, is positioned such that it is at the same height as the energizing position and separated from the energizing point in the horizontal direction; and a conveyor apparatus 5 that conveys and transfers work that has been heated at the energizing position to the processing position that is positioned such that it is at the same height as the energizing position and separated from the energizing point in the horizontal direction in order to perform hot press-forming. The conveyor apparatus 5 has a guide member 54 that is located between the energizing position of the conduction heating mechanism 3 and the processing position of the hot press mechanism 4. A conveyor 7 for removing the formed product or completed part from the discharge position of the hot press-forming apparatus 1 is attached to the hot press-forming apparatus 1.

By employing conduction heating and transfer conveyance, the hot press-forming apparatus 1 of an example of the present invention only requires half or less the installation area compared to a hot press-forming system that uses a continuous heating furnace. Moreover, with the hot press-forming apparatus 1 of this example, the conduction heating time and the time to convey work from the energizing position to the processing position are both only a few seconds, with the total time required from the start of conduction heating to the completion of formation being only a few seconds to a few tens of seconds. On the other hand, with a hot press-forming system that uses a continuous heater, a few minutes are required to perform radiation heating in the furnace, so the total time required from the start of heating to the completion of forming is about 2 to 3 minutes.

Figure 2:
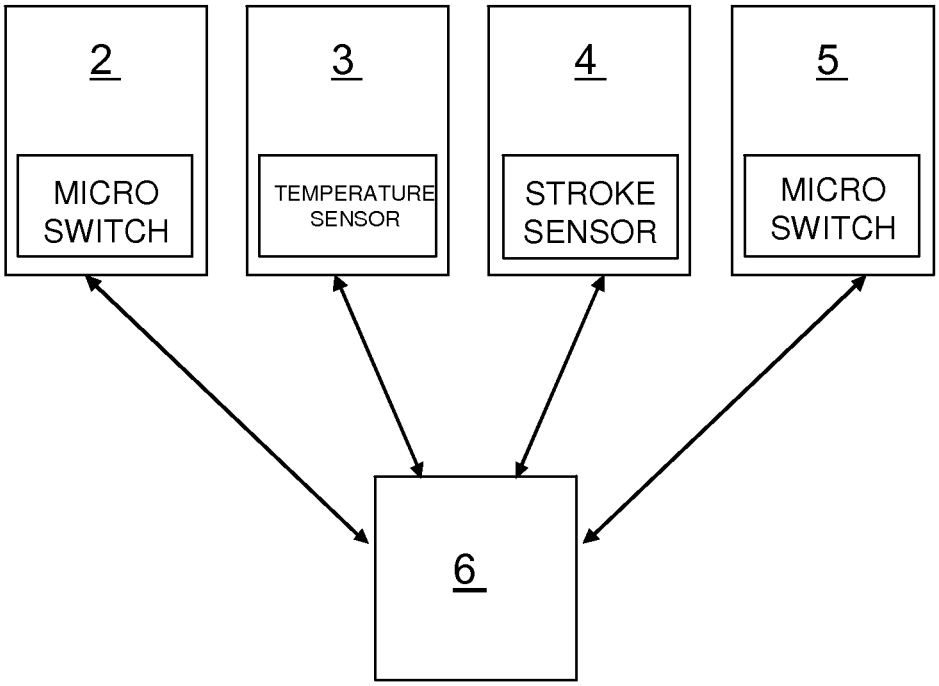
FIG. 2 is a block diagram for explaining the control structure of the hot press-forming apparatus shown in FIG. 1.

FIG. 2 is a block diagram for explaining the control structure of the hot press-forming apparatus shown in FIG. 1. As illustrated in FIG. 2, the hot press-forming apparatus 1 comprises a feeding mechanism 2, a conduction heating mechanism 3, a hot press mechanism 4, a conveyor apparatus 5 and a control mechanism 6 for synchronizing and operating these mechanisms and apparatus 2 to 5. The control mechanism 6 may further control a conveyor 7.

The feeding mechanism 2 is a robot mechanism that, according to an instruction from the control mechanism 6, takes work or a blank one at a time from a magazine in which a plurality of works or blanks are stored, and supplies the work one at a time to the feeding position of the conduction heating mechanism 3 or hot press-forming apparatus 1.

The conduction heating mechanism 3, according to an instruction from the control mechanism 6, clamps or unclamps the work fed, as well as energizes and heats the work that is clamped and for which conveying has stopped.

The hot press mechanism 4, according to an instruction from the control mechanism 6, performs hot pressing and rapid cooling of the heated work, and basically forms the formed product from the work by performing hot pressing one time.

The conveyor apparatus 5, according to an instruction from the control mechanism (unit) 6, freely clamps both end sections in the lengthwise direction of the conduction heated work, and can hold or release hold of the work at the feeding position where the work or blank is fed into the hot press-forming apparatus 1 or conduction heating mechanism 3, at the energizing position where the conduction heating mechanism 3 energizes the work, at the processing position where the hot press mechanism 4 hot presses the work, and at the discharge position where the work or formed product is discharged from the hot press-forming apparatus 1. In addition, the conveyor apparatus 5 moves back-and-forth between the feeding position and the energizing position, between the energizing position and the processing position, and between the processing position and discharge position.

The control mechanism 6 comprises: various sensors that are provided in the mechanisms and apparatus 2 to 5, for example a stroke sensor that monitors the stroke of the die of the hot press mechanism 4 and a microswitch that detects status of the feeding unit 1 and the conveyor apparatus 5 and drive units thereof, for example an air cylinder; and a microcomputer that receives information that is outputted from sensors, such as a temperature sensor that detects the temperature of a blank that was heated by the conduction heating mechanism 3, and sends control signals based on that information in order to synchronously operate the mechanisms and apparatus 2 to 5.

Figure 4:
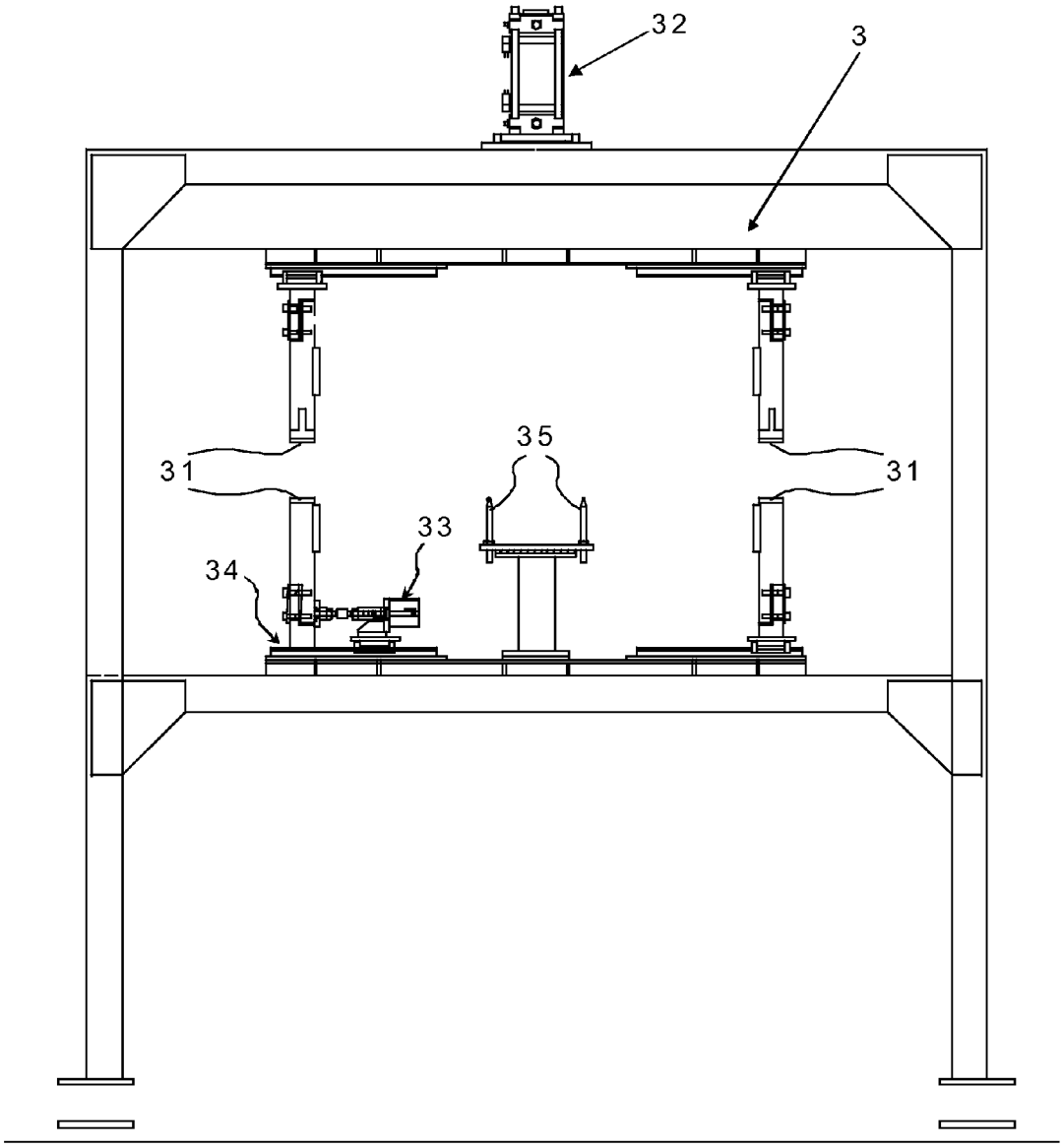
FIG. 4 is an enlarged drawing of FIG. 3C.
Figure 5:
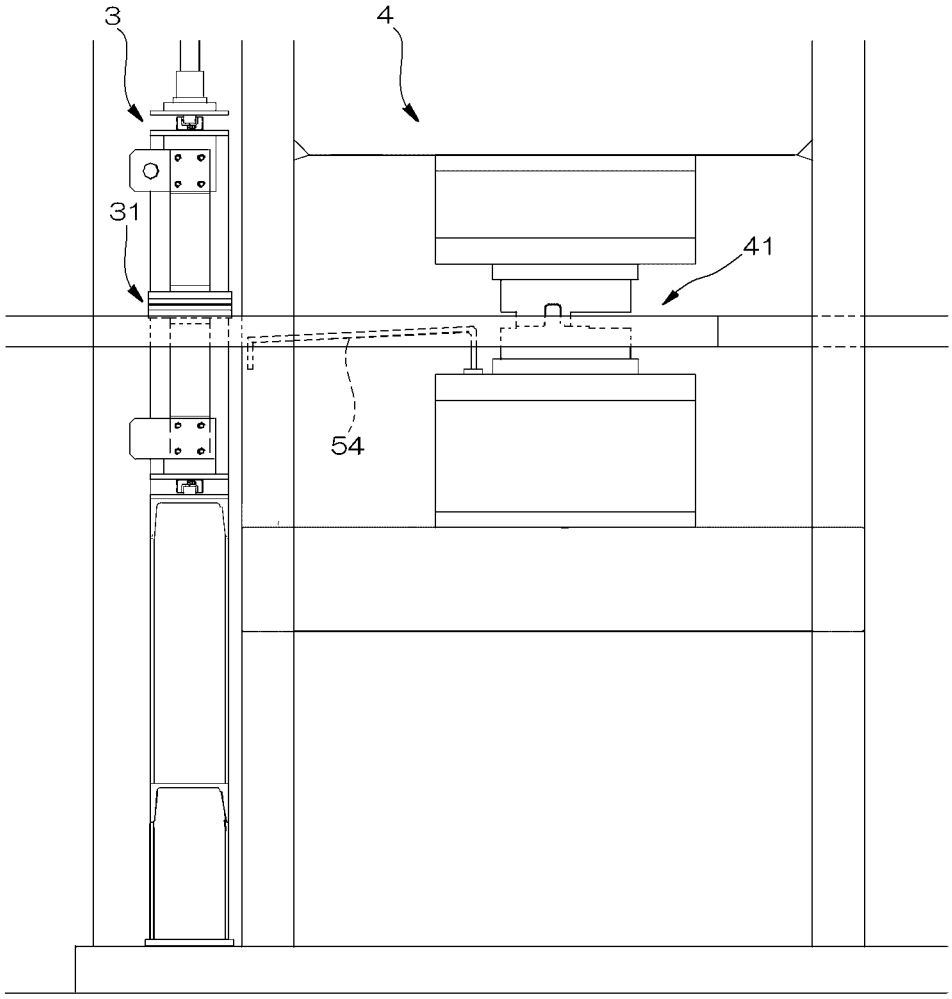
FIG. 5 is an enlarged drawing of the major parts of FIG. 3B.

FIGS. 3A to 3C are three drawings for explaining the conveyor apparatus that is illustrated in FIG. 1, where FIG. 3A is a top view, FIG. 3B is a front view and FIG. 3C is a side view. FIG. 4 is an enlarged view of FIG. 3C. FIG. 5 is an enlarged view of the major parts of FIG. 3B.

As is illustrated in FIGS. 3A to 3C, FIG. 4 and FIG. 5 as a reference, in the hot press-forming apparatus 1, a feeding position P0 where work or a blank is fed, an energizing position P1 where conduction heating is performed by the conduction heating mechanism 3, a processing position P2 where hot pressing or die quenching is performed by the hot press mechanism 4, and a discharge position P3 where work or a formed product is discharged from the hot press-forming apparatus 1 are set at uniform pitch in order along the conveyance direction from upstream to downstream. The feeding position P0, energizing position P1, processing position P2 and discharge position P3 are all positioned at the same height.

The conduction heating mechanism 3 has a plurality of electrodes 31 that clamp and energize a blank at the energizing position P1, an electrode raising and lowering cylinder 32 that raises or lowers the plurality of electrodes 31 and clamps or unclamps work, a movable clamp cylinder 33 that freely drives and moves a pair of vertically opposed electrodes 31 in a specified direction or along the lengthwise direction of the work, a straight movement guide 34 that guides the pair of moving electrodes 31, and support rods 35 that are located directly underneath the energizing position P1 and freely support the middle section of a blank by preventing as much as possible any drooping of the middle section of a blank caused by conduction heating. Preferably, of the pairs of upper and lower electrodes (31, 31), (31, 31) that face each other on the left and right, the clamped position by the pair of upper and lower electrodes (31, 31) on one side is fixed, and the pair of upper and lower electrodes (31, 31) on the other side move along in the lengthwise direction of the blank. During conduction heating, the pair of upper and lower electrodes (31, 31) on the one side hold one side of the blank at the fixed position, and the pair of upper and lower electrodes (31, 31) on the other side hold the other side of the blank, while at the same time apply adequate tension to the work by moving along the lengthwise direction of the blank according to the thermal deformation of the blank in order to prevent as much as possible any deformation of the work.

The hot press mechanism 4 comprises a cooling die 41 that performs hot pressing and rapid cooling (quenching) of the conduction heated work at the processing position P2.

The conveyor apparatus 5 comprises: a pair of parallel arms 51 that extend along the conveyance direction of the work; a plurality of pairs of clamps 53*a* to 53*c* (see (A) of FIG. 7), which are holding members, that are attached to the pair of parallel arms 51 at specified intervals along the conveyance direction, and are such that they clamp and support both end sections in the lengthwise direction of the work when the pair of parallel arms 51 come close to each other in the width direction, and release support when the pair of parallel arms 51 separate from each other; cylinders 52*a* to 52*c* (see (A) and (A') of FIG. 7), which are drive units, that drive the pairs of parallel arms 51 such that they can freely move back-and-forth in the conveyance direction, in the up and down (vertical) direction perpendicular to the conveyance direction, and in the width direction perpendicular to the conveyance direction and up and down direction; and a guide member 54 that is inclined and extends between the energizing position P1 and processing position P2 such that the processing position P2 side is higher than the energizing position side P1, and guides and supports the middle section in the lengthwise direction of the work W that is conduction heated and is being conveyed toward the processing position P2.

The guide member 54 is a rail on which the underneath surface of the work can slide, and is formed from pipe. Particularly, as is illustrated in FIG. 3A, a plurality of guide members 54 are arranged along the lengthwise direction of the work according to the length in the lengthwise direction of the work. Especially, as illustrated in FIG. 5, the angle of incline of the guide members 54 is set according to the material of the work, the heated temperature and the stroke width in the up and down direction of the conveyor apparatus 5.

The plurality of pairs of clamps 53*a* to 53*c* are arranged with uniform pitch on a pair of parallel arms 51 to correspond to the interval between the feeding position P0, energizing position P1, processing position P2 and discharge position P3. It is possible to use various kinds of pairs of holding fixtures such as tabs that hold the work, fixtures that are driven by air cylinders, chucks, suction plates and the like as the plurality of pairs of clamps 53*a* to 53*c*. As the driving method, it is possible to use servomotors instead of cylinders 52*a* to 52*c*.

Figure 6:
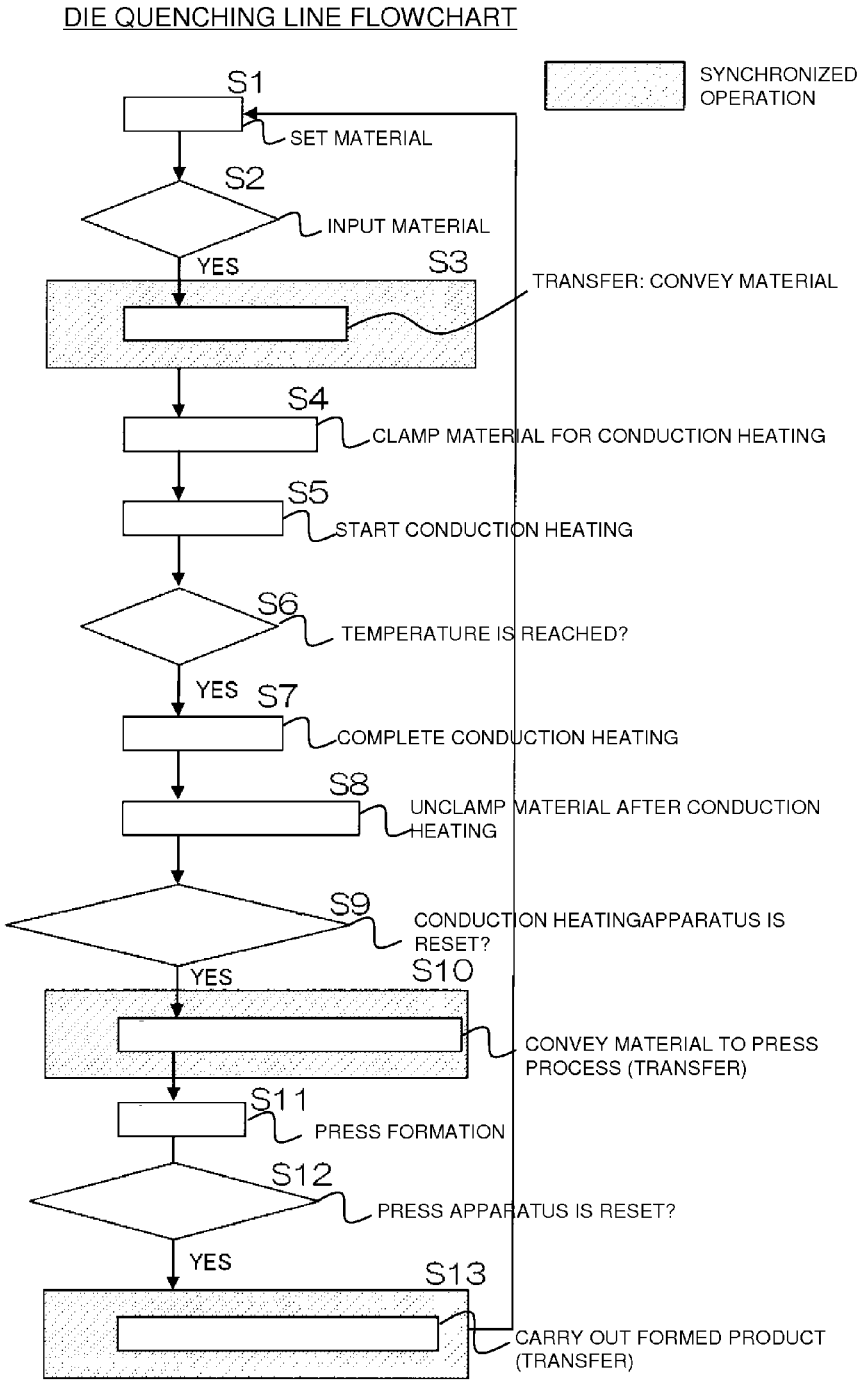
FIG. 6 is a flowchart for explaining the basic conveying process of the conveyor apparatus of an example of the present invention.

The basic conveyance process by the conveyor apparatus of an example of the present invention, and the heating and forming process by the hot press-forming apparatus of the example described above will be explained. FIG. 6 is a flowchart for explaining the basic conveyance process by the conveyor apparatus, and the heating and forming process by the hot press-forming apparatus of an example of the present invention.

As illustrated in FIG. 3A to FIG. 3C and FIG. 6 as a reference, in step S1, the feeding mechanism 2, such as a robot mechanism, sets the first work or blank (material) at the feeding position P0; in step S2, when the feeding or setting of the work is detected, the conveyor apparatus 5 begins to operate; in step S3, the conveyor apparatus 5 conveys the work from the feeding position P0 to the energizing position P1; in step S4, the conveyor apparatus 5 releases holding the work, and the conduction heating mechanism 3 clamps the work; in step S5, conveying stops and the conduction heating mechanism 3 performs conduction heating of the work; in step S6, the temperature sensor (see FIG. 2) of the conduction heating mechanism 3 detects that the temperature of the work has reached a specified temperature; in step S7, the conduction heating mechanism 3 stops conduction heating; in step S8, the conduction heating mechanism 3 releases the clamp on the work; in step S9, it is confirmed that the conduction heating mechanism 3 or conduction heating device has been returned to its original position; in step S10, the conveyor apparatus 5 supports the conduction heated work and conveys the work from the energizing position P1 to the processing position P2; in step S11, at the processing position, the cooling die 41 of the hot press mechanism 4 performs hot press-forming and rapid cooling, or in other words, performs "die quenching"; in step S12, it is confirmed that the cooling die 41 of the hot press mechanism 4 has returned to its original position; and in step S13, the conveyor apparatus 5 conveys or carries the work or formed product from the processing position P2 to the discharge position P3.

When the cycle explained above is continuously repeated, the process of conveying the work or blank from the feeding position P0 to the energizing position P1 in step S3, the process of conveying the completely conduction heated work from the energizing position P1 to the processing position P2 in step S10, and the process of conveying the work or formed product from the processing position P2 to the discharge position P3 in step 13 are synchronized and executed simultaneously.

In step S10, when the conduction heated work is conveyed to the hot press process, the guide members 54 of the conveyor apparatus 5 of the present invention function.

The conveyance, heating and formation processes by the hot press-forming apparatus of the example of the present invention described above will be explained in detail. (A) to (H) of FIG. 7 are process drawings for explaining the basic conveyance process by the conveyor apparatus of an example of the present invention.

As illustrated in (A) and (A') of FIG. 7 as a reference, at the initial position of the conveyor apparatus 5, a pair of parallel arms 51 are located in the lowered position and are separated from each other.

As illustrated in (A) and (B) of FIG. 7 as a reference, the cylinder 52*c* drives the pair of parallel arms 51 in the width direction toward each other, and a plurality of pairs of clamps 53*a* to 53*c* clamp the new work or blank W0 at the feeding position P0, clamp the completely conduction heated work W1 at the energizing position P1, and clamp the die quenched work or formed product W2 at the processing position P2. The plurality of pairs of clamps 53*a* to 53*c* themselves may be holding mechanisms that comprise a drive mechanism, or may be holding members that are driven by some other method.

As illustrated in (B) and (C) of FIG. 7 as a reference, the cylinder 52*b* drives and raises the pair of parallel arms 51.

As illustrated in (C) and (D) of FIG. 7 as a reference, the cylinder 52*a* drives and moves the pair of parallel arms 51 forward to the downstream side in conveyance direction, and the plurality of pairs of clamps 53*a* to 53*c* move to the energizing position P1, processing position P2 and discharge position P3, respectively.

As illustrated in (D) and (E) of FIG. 7 as a reference, the cylinder 52*b* drives and lowers the pair of parallel arms 51.

As illustrated in (E) and (F) of FIG. 7 as a reference, the cylinder 52*c* drives and separates the pair of parallel arms 51 in the width direction, and the plurality of pairs of clamps 53*a* to 53*c* unclamp new work or blank W0 at the energizing position P1, unclamp the conduction heated work W1 at the processing position P2 and unclamp the die quenched work or formed product W2 at the discharge position P3, respectively.

As illustrated in (F) and (G) of FIG. 7 as a reference, cylinder 52*b* drives and raises the pair of parallel arms 51, then as illustrated in (G) and (H) of FIG. 7 as a reference, cylinder 52*a* drives the pair of parallel arms 51 and moves them back to the upstream side in the conveyance direction, and the plurality of pairs of clamps 53*a* to 53*c* return to the feeding position P0, energizing position P1 and processing position P2, respectively. Between these, in synchronization with each other, new work or blank W00 is fed at feeding position P0, work W0 is conduction heated at energizing position P1, work W1 is hot pressed at processing position P2 and work or formed product W2 is removed from discharge position P3.

Figure 8:
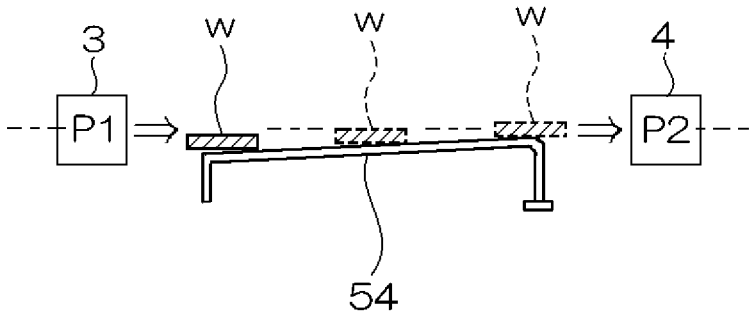
FIG. 8 is a process diagram for explaining the function of a guide member of the conveyor apparatus of an example of the present invention.

FIG. 8 is a process diagram for explaining the function of a guide member of the conveyor apparatus of an example of the present invention.

Referring to FIG. 8, in step S10 of FIG. 6, or in other words, when conveying the conduction heated work W1 in (B) and (C) of FIG. 7 from the energizing position P1 to the processing position P2, a pair of clamps 53*b* hold both end sections of the work W1, and the guide member 54 supports and guides the bottom surface of the middle section of the work W1. In this way, even when the middle section of the work W1 droops a lot due to thermal deformation, the guide member 54 supports the drooping middle section from underneath, and the work W1 is conveyed toward the processing position P2, which is at the same height as the energizing position P1 by sliding on the guide member 54.

Industrial Applicability

The conveyor apparatus and hot press-forming apparatus comprising the same of the present invention is applied to the formation or manufacture, and particularly die quenching of sheet metal material, and more specifically is applied to the formation or manufacture of automobile parts for which mass production is required, for example is preferably applied to the formation or manufacture of various reinforced members, particularly door beams and bumper reinforcement of an automobile body.

The modes or examples of the invention can be modified or adjusted within the framework of the entire disclosures (including the claims) of the present invention, and a based on the technical scope of the invention. Moreover, various combinations or selections of the various disclosed elements are possible within the scope of the claims of the present invention.

What is claimed is:

1. A conveyor apparatus that conveys work that has been electrically heated through current conduction at an energizing position to a processing position that is separated in a horizontal direction from said energizing position in order to perform hot press-forming; wherein said apparatus comprises:

a holding member(s) that freely clamps both end sections in the lengthwise direction of said work that has been electrically heated through current conduction;

a drive mechanism that moves said holding member(s) from said energizing position to said processing position; and a guide member that extends between said energizing position and said processing position and is capable of contacting and supporting a thermal deformation or drooping middle section in a lengthwise direction of said work sliding relative to the guide member in a conveyance direction that has been electrically heated through current conduction and is under conveyance toward said processing position, and wherein an angle of inclination of the guide member is fixed during conveyance of said work from said energizing position to said processing position, and is inclined such that a processing position side is higher than an energizing position side such as to guide the thermal drooped middle section of the heated work up to a height of the processing position.

2. The conveyor apparatus of claim 1, wherein said processing position is at the same height as said energizing position.

3. The conveyor apparatus of claim 1, wherein said guide member is a rail on which an underneath surface of said work can slide.

4. The conveyor apparatus of claim 1, wherein a plurality of said guide members are arranged along a lengthwise direction of said work.

5. The conveyor apparatus of claim 1, wherein said holding member(s) freely holds said work at least said energizing position and said processing position, respectively, and freely moves back-and-forth between both the positions.

6. The conveyor apparatus of claim 5, wherein a plurality of said holding members are provided and further hold said work at feeding position where said work is fed and at a discharge position where work formed by hot pressing is discharged, and move back-and-forth between said feeding position and said energizing position, between said energizing position and said processing position and between said processing position and said discharge position.

7. The conveyor apparatus of claim 1, further comprising:

a pair of parallel arms that extend along the conveyance direction of said work and to which a pair of said holding members are mounted; wherein said drive mechanism comprises:

a conveyance direction drive mechanism that can freely and horizontally drive and move said pair of parallel arms in said conveyance direction;

a raising and lowering drive mechanism that can freely drive and move said pair of parallel arms back-and-forth in the up and down direction; and a width direction drive mechanism that can freely drive and move said pair of parallel arms back-and-forth in the width direction that is perpendicular to said conveyance direction and up and down direction so that said holding members can freely support said work.

8. A hot press-forming apparatus that has the conveyor apparatus of claim 1.

9. The conveyor apparatus of claim 1, wherein an angle of inclination of the guide member is set according to a material of the work, a heated temperature of the work, and/or a stroke width in an up and a down direction of the conveyor apparatus.

10. A conveying method for conveying work that has been electrically heated through current conduction at an energizing position to a processing position that is separated in a horizontal direction from said energizing position in order to perform hot press-forming; wherein said method comprises:

freely clamping, by a holding member(s), both end sections in the lengthwise direction of said work that has been electrically heated through current conduction;

moving said holding member(s) from said energizing position to said processing position, using a drive mechanism;

contacting and supporting a thermal deformation or drooping middle section in a lengthwise direction of said work sliding relative to the guide member in a conveyance direction that has been electrically heated through current conduction and is under conveyance toward said processing position, by using a guide member(s), being inclined such that that a processing position side is higher than an energizing position side, and such as to guide the thermal drooped middle section of the heated work up to a height of the processing position; and fixing the angle of inclination of the guide member during conveyance of said work from said energizing position to said processing position.

11. The conveying method of claim 10, wherein said processing position is at the same height as said energizing position.

12. The conveying method of claim 10, wherein said guide member is a rail on which an underneath surface of said work can slide.

13. The conveying method of claim 10, wherein a plurality of said guide members are arranged along a lengthwise direction of said work.

14. The conveying method of claim 10, wherein said holding member(s) freely holds said work at least said energizing position and said processing position, respectively, and freely moves back-and-forth between both the positions.

15. The conveying method of claim 14, wherein a plurality of said holding members are provided and further hold said work at feeding position where said work is fed and at a discharge position where work formed by hot pressing is discharged, and move back-and-forth between said feeding position and said energizing position, between said energizing position and said processing position and between said processing position and said discharge position.

16. The conveying method of claim 10, further comprising:

providing a pair of parallel arms that extend along the conveyance direction of said work and to which a pair of said holding members are mounted; wherein freely and horizontally driving and moving said pair of parallel arms in said conveyance direction, using a conveyance direction drive mechanism;

driving and moving said pair of parallel arms back-and-forth in the up and down direction, using a raising and lowering drive mechanism; and freely driving and moving said pair of parallel arms back-and-forth in the width direction that is perpendicular to said conveyance direction and up and down direction so that said holding members can freely support said work, using a width direction drive mechanism.

17. The conveying method of claim 10, comprising:

setting an angle of inclination of the guide member according to a material of the work, a heated temperature of the work, and/or a stroke width in an up and a down direction of the conveyor apparatus.

* * * * *